US010593457B2

(12) United States Patent
Wang

(10) Patent No.: US 10,593,457 B2
(45) Date of Patent: Mar. 17, 2020

(54) CONTROL METHOD, FORCE-APPLYING APPARATUS, ELECTRONIC DEVICE, AND SYSTEM

(71) Applicant: Lenovo (Beijing) Limited, Beijing (CN)

(72) Inventor: Jing Wang, Beijing (CN)

(73) Assignee: LENOVO (BEIJING) LIMITED, Beijing (CN)

( * ) Notice: Subject to any disclaimer, the term of this patent is extended or adjusted under 35 U.S.C. 154(b) by 274 days.

(21) Appl. No.: 15/465,389

(22) Filed: Mar. 21, 2017

(65) Prior Publication Data

US 2017/0271066 A1 Sep. 21, 2017

(30) Foreign Application Priority Data

Mar. 21, 2016 (CN) ..... 2016 1 0161818

(51) Int. Cl.
*H01F 7/06* (2006.01)
*H01F 7/08* (2006.01)

(52) U.S. Cl.
CPC ..... *H01F 7/064* (2013.01); *H01F 7/081* (2013.01)

(58) Field of Classification Search
CPC ..... H01F 7/064; H01F 7/081
USPC ..... 361/144
See application file for complete search history.

(56) References Cited

U.S. PATENT DOCUMENTS

| | | | | |
|---|---|---|---|---|
| 7,328,999 | B2 | 2/2008 | Zelman | |
| 2008/0049315 | A1* | 2/2008 | Morikuni | G03B 21/62 359/457 |
| 2015/0291172 | A1* | 10/2015 | Kim | B60W 30/1884 123/445 |
| 2017/0108895 | A1* | 4/2017 | Chamberlin | H04M 1/04 |

FOREIGN PATENT DOCUMENTS

| | | | |
|---|---|---|---|
| CN | 200958924 | Y | 10/2007 |
| CN | 102102695 | A | 6/2011 |
| CN | 102184662 | A | 9/2011 |
| CN | 102523408 | A | 6/2012 |

* cited by examiner

*Primary Examiner* — Kevin J Comber
(74) *Attorney, Agent, or Firm* — Kunzler Bean & Adamson, PC

(57) ABSTRACT

A method is disclosed. The method may include providing a force-applying apparatus installed on a first body and disposed between the first body and a second body. The method may include receiving, through the force-applying apparatus, a first control instruction. The method may include generating a first acting force from the force-applying apparatus based on the first control instruction, the first acting force pushing the second body away from the first body. An apparatus and system are also disclosed.

20 Claims, 12 Drawing Sheets

CONTROL METHOD, FORCE-APPLYING APPARATUS, ELECTRONIC DEVICE, AND SYSTEM

FIELD

The present application relates to the field of mechanical design technology and in particular to a control method, force-applying apparatus, electronic device, and system.

BACKGROUND

A natural magnet may be provided between a projector and a base for the projector. The magnet may provide magnetic attraction between the projector and base, thus helping secure the projector to the base.

However, since the magnetic force of a natural magnet is fixed, users may need to exert differing amounts of force to remove and install the projector on the base. For example, if the magnetic force is large, users may need to apply extra force to remove the projector. If the magnetic force is too weak, there may be a poor or unsecure connection between the projector and the base.

SUMMARY

In one embodiment, a method is disclosed. The method may include providing a force-applying apparatus installed on a first body and disposed adjacent to a second body. In one embodiment, the method may include receiving, through the force-applying apparatus, a first control instruction. In one embodiment, the method may include generating a first acting force from the force-applying apparatus based on the first control instruction. The first acting force may push the second body away from the first body.

In some embodiments, providing the force-applying apparatus may include providing an electromagnet. Generating the first acting force may include the electromagnet producing, in response to the first control instruction, a magnetic polarity identical to a magnetic polarity of the second body. In one embodiment, producing the magnetic polarity may include the electromagnet generating a repelling magnetic force between the electromagnet and the second body. The magnetic force may push the second body away from the first body.

In one embodiment, providing the force-applying apparatus may include providing a spring. Generating the first acting force may include the spring moving, in response to receiving the first control instruction, from a compressed state to a relaxed state. In some embodiments, the spring moving from a compressed state to a relaxed state may generate a thrust force between the spring and the second body. The thrust force may push the second body away from the first body.

In one embodiment, receiving the first control instruction may include wirelessly receiving the first control instruction.

In one embodiment, an apparatus is disclosed. In some embodiments, the apparatus may include a control component. The control component may receive a first control instruction. In one embodiment, the apparatus may include a force-generating component. The force-generating component may generate a first acting force based on the first control instruction. The apparatus may be disposed adjacent to a first body and a second body. The first acting force may push the second body away from the first body.

In some embodiments, the force-generating component may include an electromagnet. The electromagnet may produce, in response to the first control instruction, a magnetic polarity identical to a magnetic polarity of the second body. In one embodiment, the magnetic polarity may include a repelling magnetic force between the electromagnet and the second body. The repelling magnetic force may push the second body away from the first body.

In one embodiment, the control component may include a power transmission line. In some embodiments, the control component may include a switch module. The power transmission line, the switch module, and the electromagnet may form a powered-up circuit. The powered-up circuit may generate the magnetic polarity in response to powering up. In one embodiment, the switch module may include a touch switch or a button.

In some embodiments, the force-generating component may include a spring that moves, in response to the first control instruction, from a compressed state to a relaxed state. The spring may generate a thrust force between the spring and the second body. The thrust force may push the second body away from the first body. In one embodiment, the control component may include a compression controller. The compression controller may maintain the spring in a compressed state. The compression controller may move the spring from the compressed state to a relaxed state in response to the compression controller activating.

In one embodiment, the control component may include a wireless communication interface.

In some embodiments, a system is disclosed. In one embodiment, the system may include a system body. In one embodiment, the system may include an electronic device. In some embodiments, the electronic device may include a first body and/or a second body connected to the system body. In one embodiment, the electronic device may include a force-applying apparatus installed on the first body and in contact with the second body. The force-applying apparatus may generate a first acting force that may push the second body away from the first body.

In one embodiment, the force-applying apparatus may include an electromagnet. The electromagnet may produce, in response to the force-applying apparatus receiving a first control instruction, a magnetic polarity identical to a magnetic polarity of the second body. In some embodiments, the magnetic polarity may include a repelling magnetic force between the electromagnet and the second body. The repelling magnetic force may push the second body away from the first body.

In some embodiments, the force-applying apparatus may include a spring that moves, in response to the force-applying apparatus receiving a first control instruction, from a compressed state to a relaxed state. The spring may generate a thrust force between the spring and the second body. The thrust force may push the second body away from the first body. In one embodiment, the force-applying apparatus may include a compression controller. The compression controller may maintain the spring in a compressed state and may move the spring from the compressed state to a relaxed state in response to the compression controller activating.

In one embodiment, the system body may include a supporting structure that may maintains the electronic device in a fixed position.

BRIEF DESCRIPTION OF THE DRAWINGS

To describe the technical solutions according to the embodiments of the present invention or the technical solutions in the related art more clearly, accompanying drawings used for describing the embodiments are hereinafter briefly introduced. It is apparent that the accompanying drawings hereinafter are only intended to illustrate some embodiments of the present application.

DETAILED DESCRIPTION

The technical solution in the embodiments of the present disclosure is described with reference to the accompanying drawings in the embodiments. It is apparent that the embodiments described are not all, but rather only some of the embodiments of the present disclosure. All other embodiments obtained by a person skilled in the art based on the embodiments of the present disclosure fall within the protection scope of the present disclosure.

Figure 1:
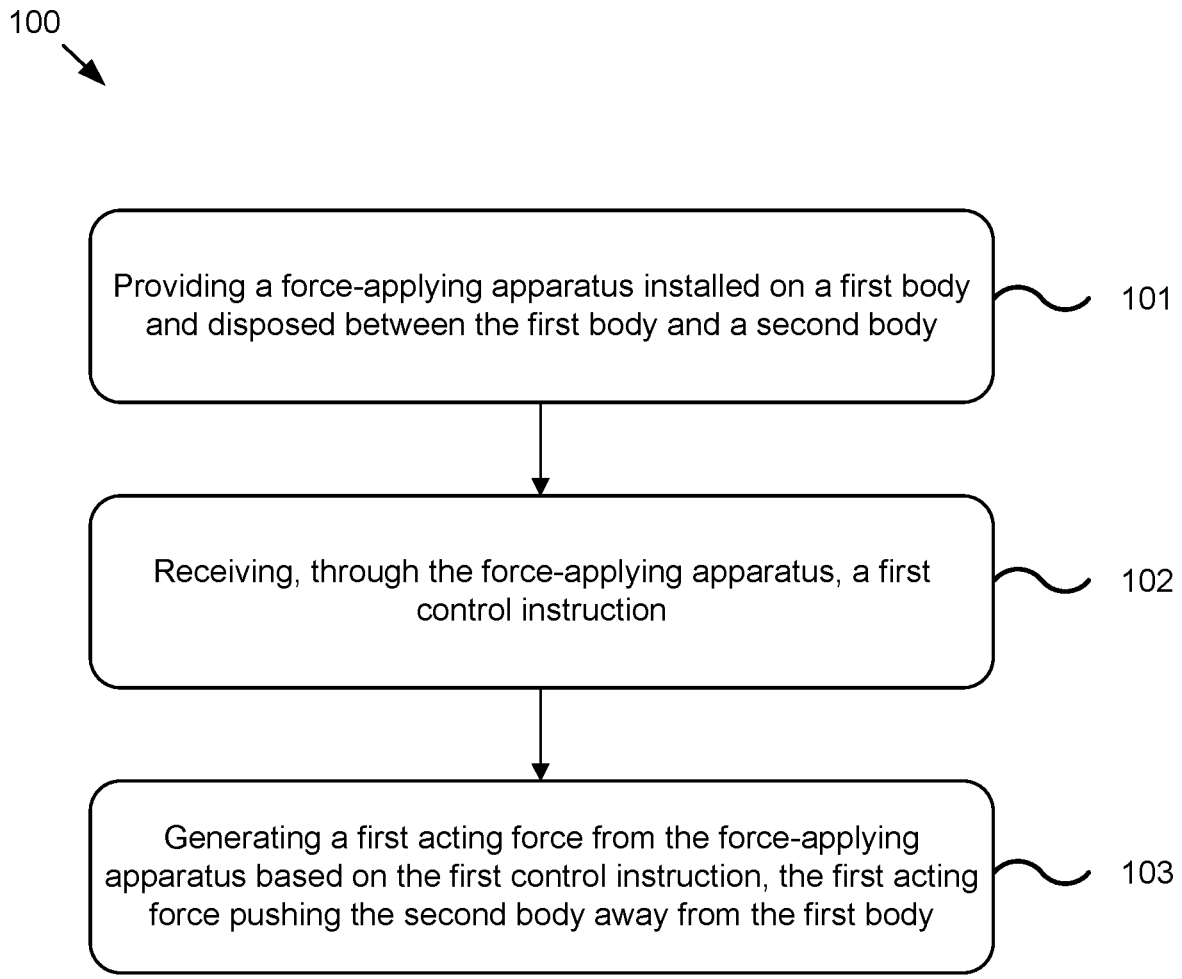
FIG. 1 is a schematic flowchart diagram illustrating one embodiment of a method.

FIG. 1 depicts one embodiment of a method 100. The method 100 may apply to or may be implemented by an apparatus. The method 100 may control a force effect of the apparatus. The apparatus may be installed on a first body. The first body may be in contact with a second body.

Figure 2A:
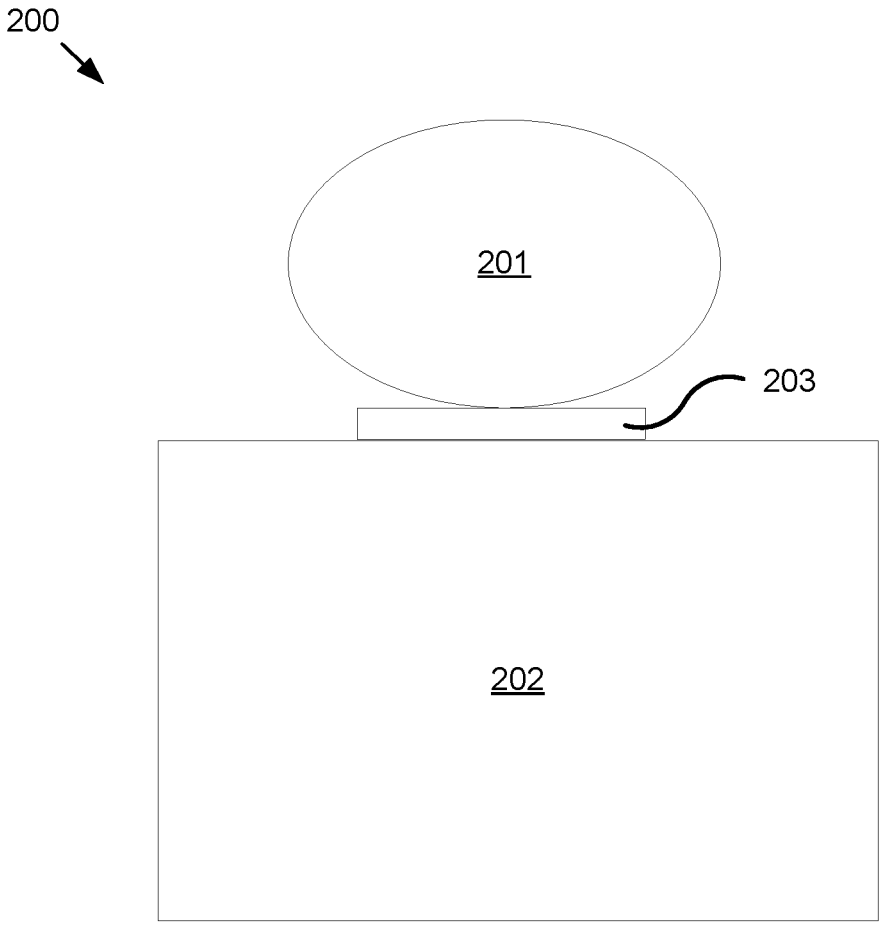
FIG. 2*a* is an illustration of one embodiment of a system.

FIG. 2*a* depicts one embodiment of a system 200. In one embodiment, the system may include a first body 201, a second body 202, and/or a force-applying apparatus 203. In some embodiments, the force-applying apparatus 203 may include an apparatus that applies a force to the first body 201, the second body 202, and/or another body. In one embodiment the force-applying apparatus 203 may separate the first body 201 and/or second body 202 through something other than a force. The force applying apparatus 203 may be installed on the side of the first body 201 that may be in contact with the second body 202. The force-applying apparatus 203 may be disposed adjacent to the first body 201 and the second body 202.

Returning to FIG. 1, in one embodiment, the method 100 may include one or more of the following steps.

Step 101 Providing a force-applying apparatus installed on a first body and disposed adjacent to a second body.

In one embodiment, the force-applying apparatus may include the force-applying apparatus 203. In some embodiments, the first body and/or the second body may include the first body 201 and/or the second body 202.

Step 102 Receiving, through the force-applying apparatus, a first control instruction.

In one embodiment, the first control instruction may include a command. The command may be based on a user's command (such as a command to separate the first body and the second body of the apparatus). In one embodiment, the apparatus may receive the first control instruction.

Step 103 Generating a first acting force from the force-applying apparatus based on the first control instruction. The first acting force may push the second body away from the first body.

Figure 2B:
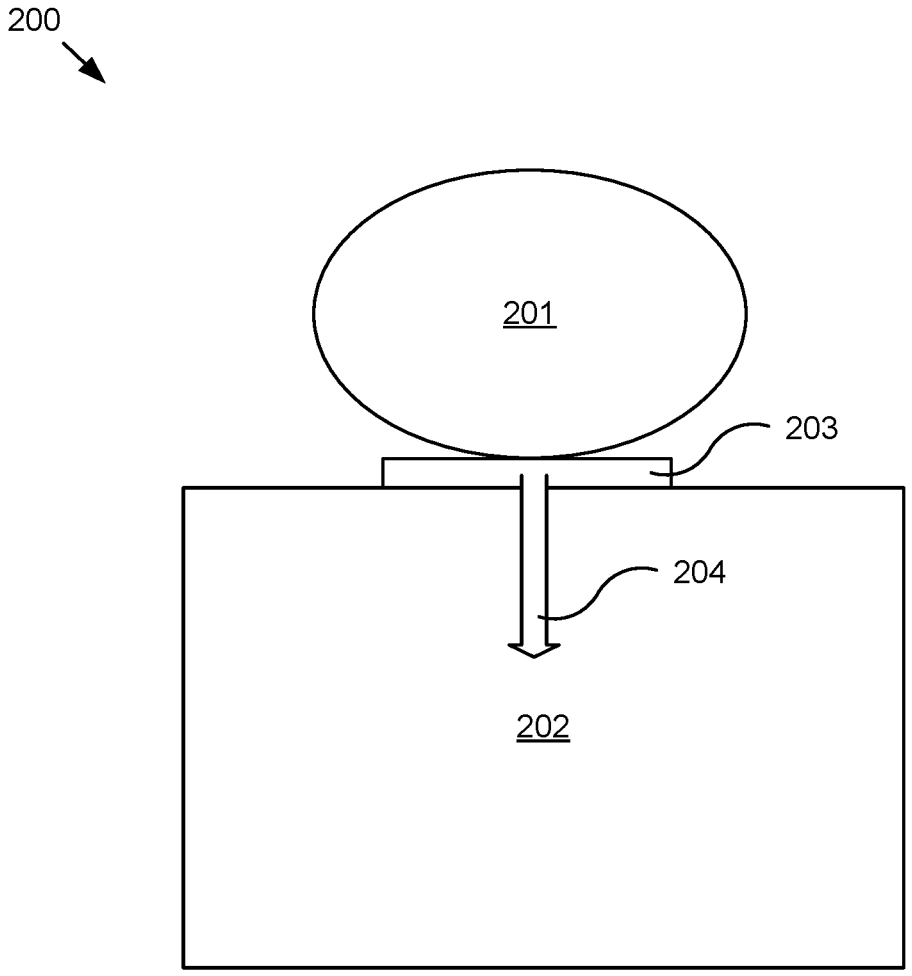
FIG. 2*b* is an illustration of another embodiment of the system.

FIG. 2*b*, depicts one embodiment of the system 200. In one embodiment, a first acting force 204 generated by the force-applying apparatus 203 may act on the second body 202 or the first body 201. The first acting force 204 may push the second body 202 away from the first body 201. In some embodiments, in response to a user applying a force to the first body 201 or second body 202, the two bodies may disconnect. The first body 201 and the second body 202 may disconnect without extra force, extra exertion, or with ease on the part of the user because of the existence of the above-mentioned first acting force. The first acting force 204 may assist the user in moving the second body 202 away from the first body 201.

In one embodiment, the first body 201 may include a projection lens. The second body 202 may include a projection base.

Figure 2C:
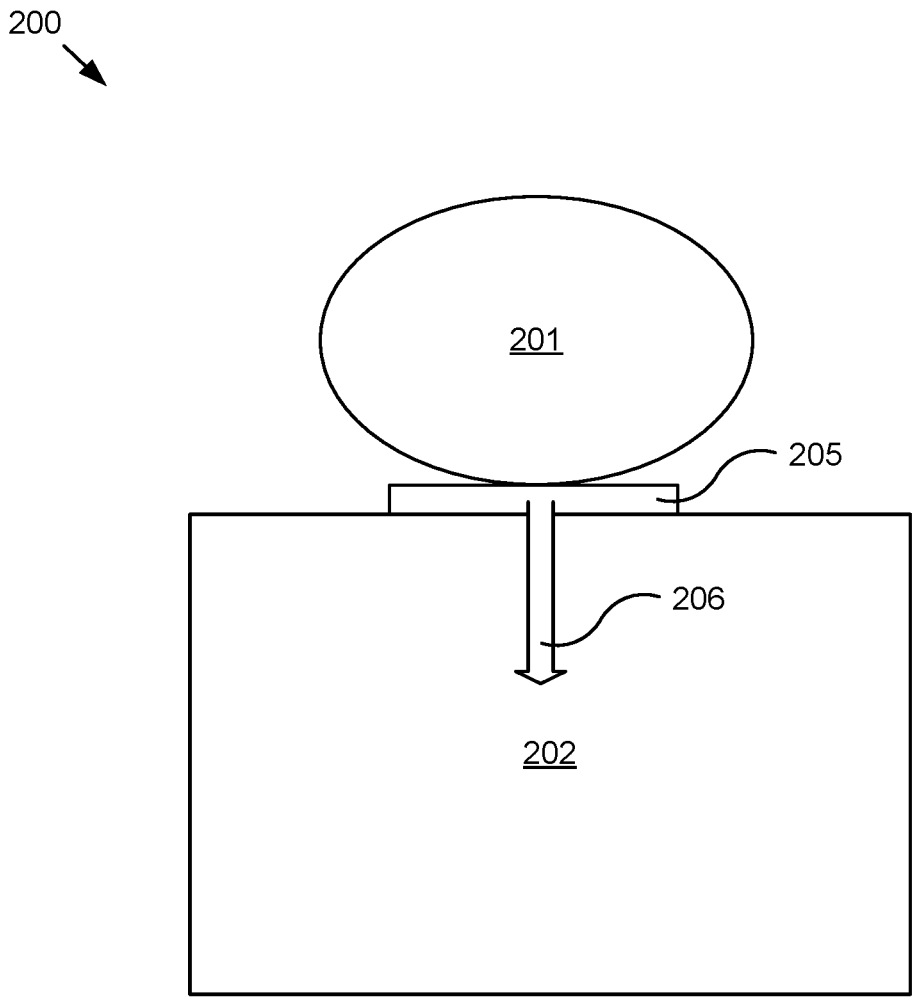
FIG. 2*c* is an illustration of another embodiment of the system.

FIG. 2*c* depicts one embodiment of the system 200. The force-applying apparatus 203 may include an electromagnet 205. The electromagnet 205 may include an unpowered state and a powered state. The mutual attraction between the electromagnet 205 and the second body 202 containing a permanent magnet may produce a secure connection between the first body 201 containing the electromagnet 205 and the second body 202. In response to the user needing to disconnect the first body 201 and the second body 202, the electromagnet 205 may respond to the first control instruction and produce magnetic polarity identical to that of the permanent magnet of the second body 202. The generated magnetic polarity may generate a first repelling magnetic force 206 that may push the second body 202 away from the first body 201. In one embodiment, the first acting force 204 may include the first repelling magnetic force 206.

Figure 2D:
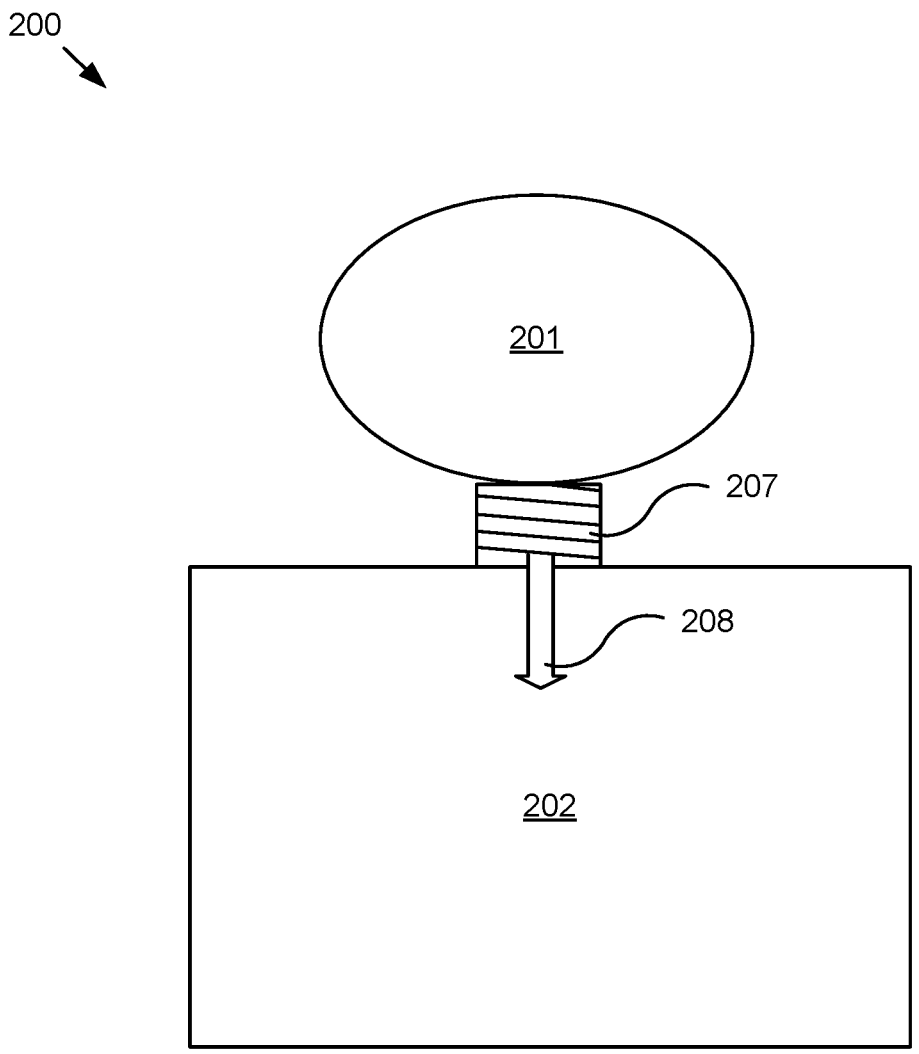
FIG. 2*d* is an illustration of diagram another embodiment of the system.

FIG. 2*d* depicts one embodiment of the system 200. In one embodiment, the force-applying apparatus 203 may include a spring 207. The spring 207 may be compressed and installed between the first body 201 and the second body 202. The spring 207 may produce a secure connection between the two bodies. In some embodiments, an elastic force 208 of the compressed spring may be suppressed by an external force and may not affect the first body 201 and the second body 202. In response to disconnecting the first body 201 and the second body 202, the user may remove the external force and allow the elastic force 208 of the compressed spring 207 to push the second body 202 away from the first body 201. In one embodiment, the first acting force may include the elastic force 208.

In one embodiment, a favorable connection may be maintained between the first body 201 and the second body 202 while they are in a relatively static state. When the first body 201 and the second body 202 are to be disconnected, users may not have to apply extra force due to the existence of the first acting force 204. As a result, user experience may be improved.

Figure 3:
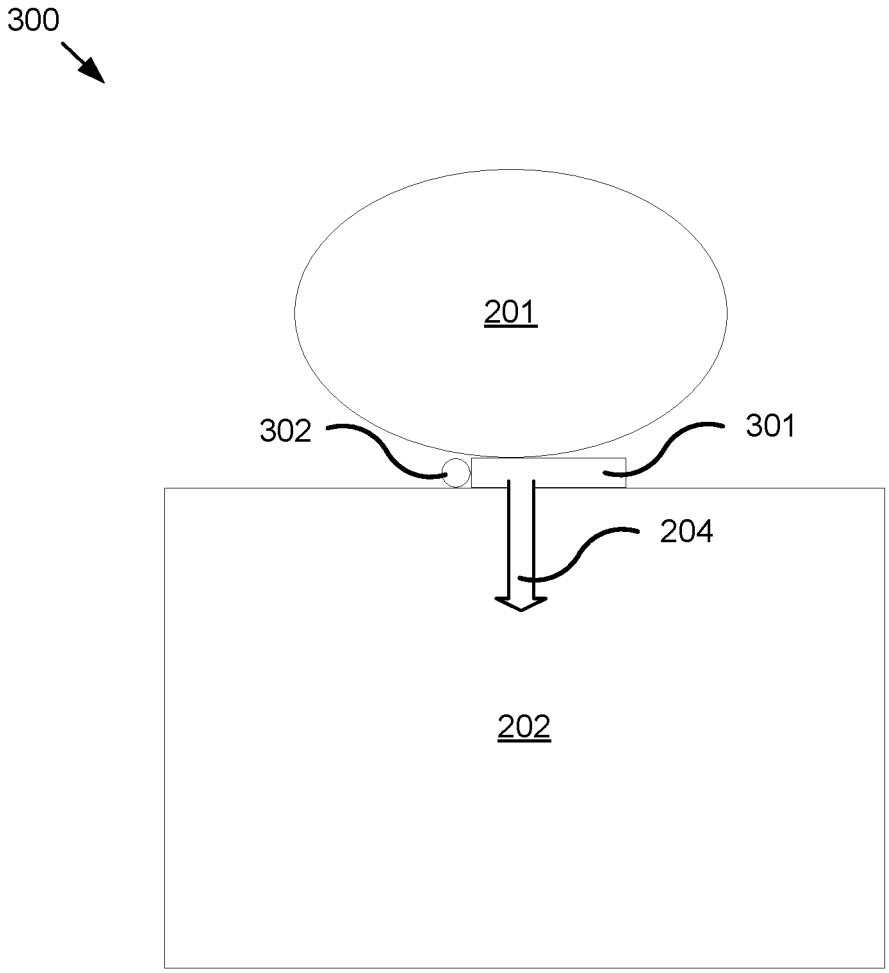
FIG. 3 is an illustration of one embodiment of a system.

FIG. 3 depicts one embodiment of a system 300. In one embodiment, the system 300 may include the first body 201, the second body 202, and/or an apparatus. In one embodiment, the apparatus may be installed on a first body 201 in contact with a second body 202. The apparatus may be disposed adjacent the first body 201 and the second body 202. The first body 201 and the second body 202 may be relatively fixed. The apparatus may be securely connected to the first body 201. In one embodiment, the first body 201 may include a projection lens and the second body 202 may include a projection base.

In one embodiment, the apparatus may include a control component 301. The control component 301 may receive the first control instruction. In one embodiment, the control component 301 may include a communication interface. The communication interface may include a Wi-Fi, Bluetooth, or other wireless communication interface. The communication interface may receive the first control instruction generated by an electronic device. In one embodiment, the wireless communication interface may receive the first control instruction wirelessly. For example, the first control instruction may include a Wi-Fi signal, a Bluetooth signal, a radio signal, a radio frequency identification (RFID) signal, or the like.

The apparatus may include a force-generating component 302. The force-generating component 302 may generate the first acting force 204 based on the first control instruction. The first acting force 204 may be used to push the second body 202 away from the first body 201.

In some embodiments, the force-generating component 302 may be located adjacent to the first body 201 and the second body 202. In some embodiment, the force-generating component 302 may be located adjacent to either the first body 201 or the second body 202. The force-generating component 302 may be installed on, and/or fixedly connected to, the first body 201. The first body 201 may be disposed above the second body 202. The force-generating component 302 may respond to the first control instruction and generate a first acting force 204. The first acting force 204 may act on the second body 202 and push the second body 202 away from the first body 201.

Figure 4:
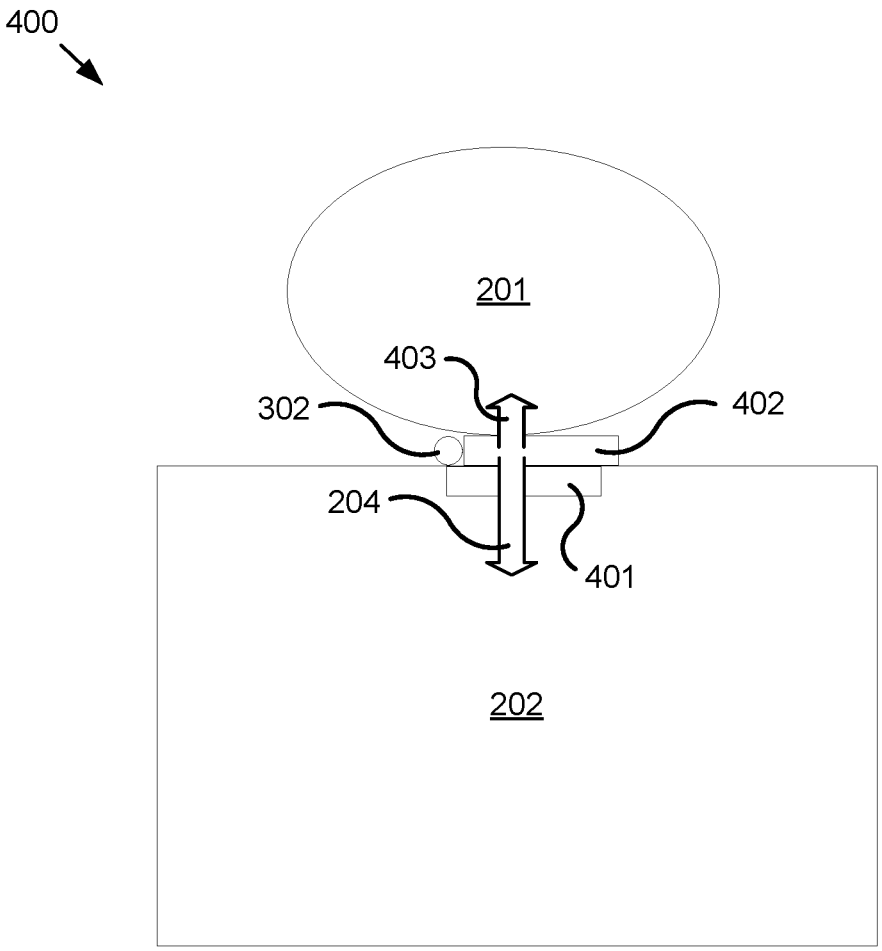
FIG. 4 is an illustration of one embodiment of a system.

FIG. 4 depicts one embodiment of a system 400. The system 400 may include the first body 201, the second body 202, and an apparatus. In one embodiment, a permanent magnet 401 may be installed on the contacting position of the second body 202 and the force-generating component 302. The force-generating component 302 may include an electromagnet 402. In some embodiments, the electromagnet 402 may include a metal bar, such as an iron bar. A secure connection between the second body 202 and the electromagnet 402 may be created by a magnetic attraction between the permanent magnet 401 and the electromagnet 402 in a powered state. In response to a user needing to separate the first body 201 and the second body 202, the control component 301 may receive the first control instruction and may supply power to the electromagnet 402. The electromagnet 402 may become magnetized with magnetic polarity identical to that of the permanent magnet 401 and generate a first repelling magnetic force 206 between the electromagnet 402 and the second body 202. The first repelling magnetic force 206 may push the second body 202 away from the first body 201. In response to the electromagnet 402 becoming magnetized with magnetic polarity identical to that of the permanent magnet 401, the permanent magnet 401 and the electromagnet 402 may generate a second repelling magnetic force 403 that may push the first body 201 away from the second body 202. In one embodiment, the first acting force 204 may include the first repelling magnetic force 206 and/or the second repelling magnetic force 403.

Figure 5:
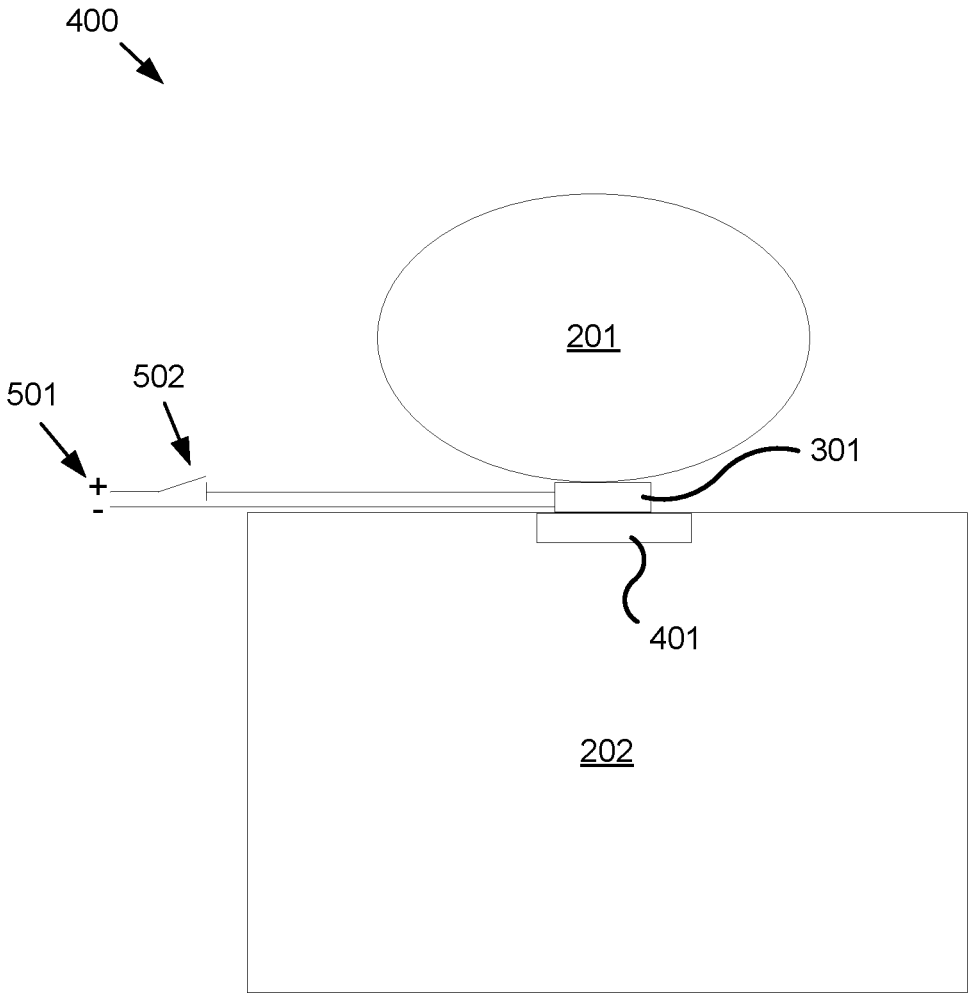
FIG. 5 is an illustration of another embodiment of the system.

FIG. 5 depicts one embodiment of the system 400. In one embodiment, the control component 301 may include a power transmission line 501 and/or a switch module 502. The power transmission line 501, the switch module 502, and the electromagnet 402 may form a powered circuit. The circuit may allow the electromagnet 402 to generate a magnetic pole in response to being powered. In some embodiments, the switch module 502 may include a touch switch or a mechanical button connecting the power transmission line 501 and the electromagnet 402 to form a powered circuit, allowing the electromagnet 402 to generate a magnetic pole in response to being powered.

Figure 6A:
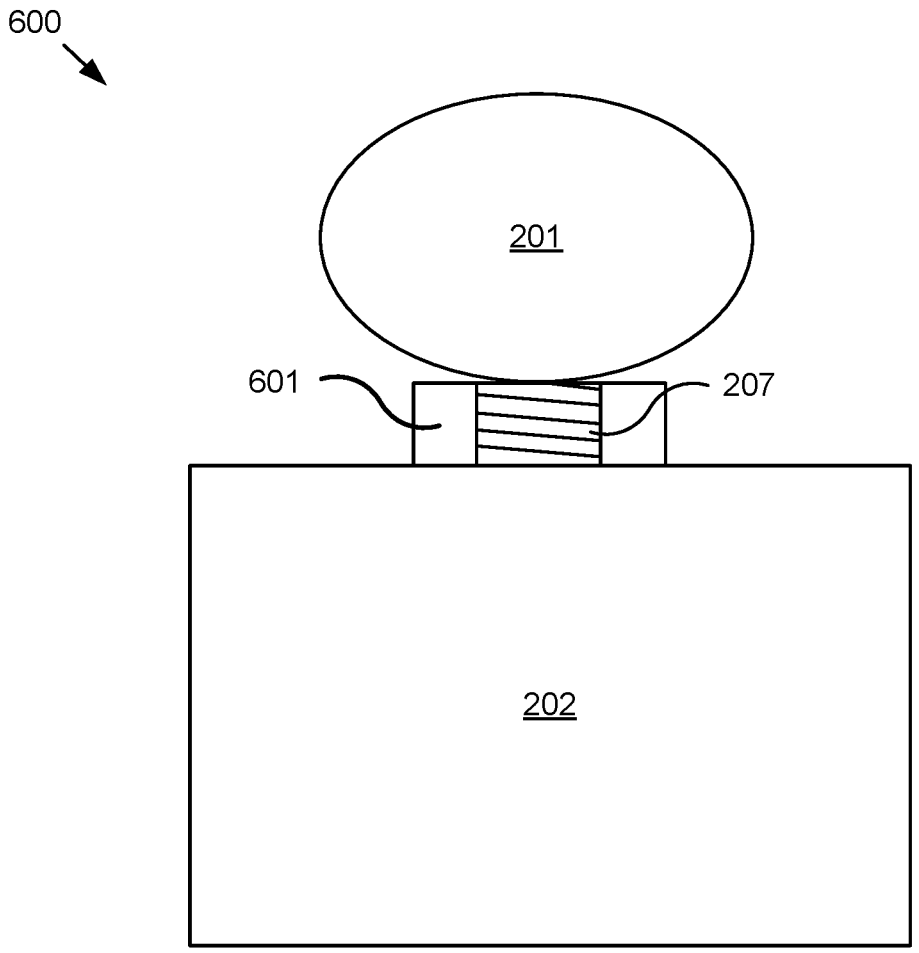
FIG. 6*a* is an illustration of another embodiment of the system.
Figure 6B:
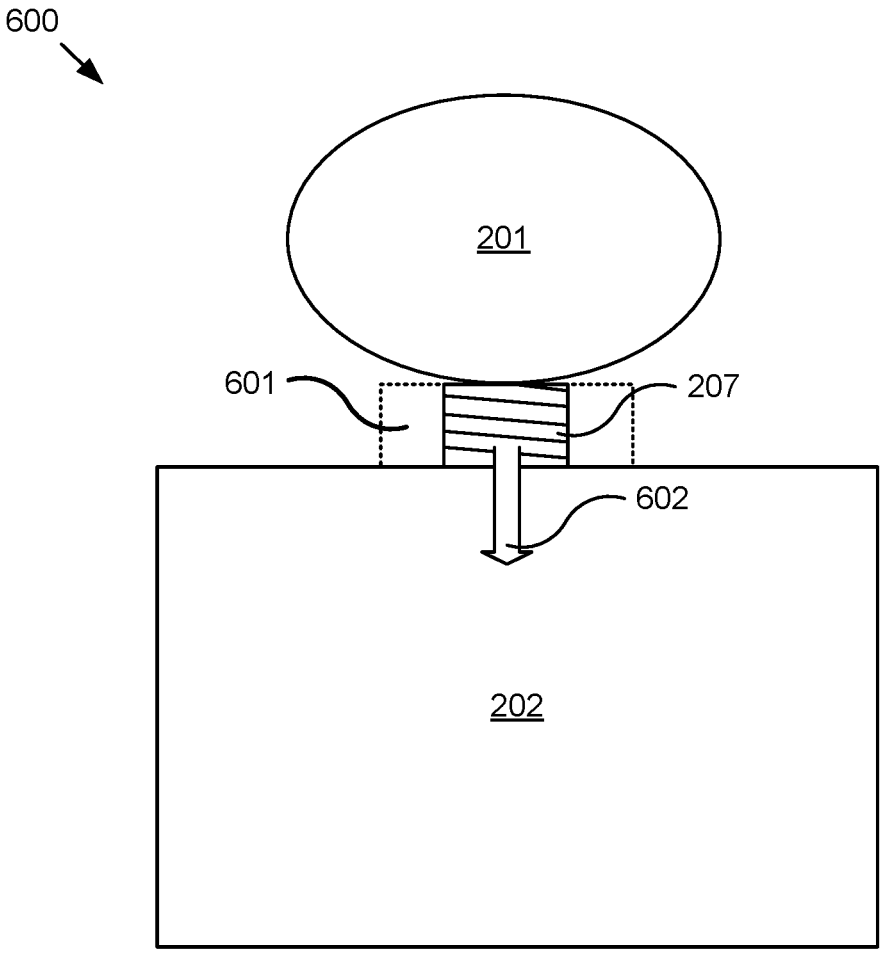
FIG. 6*b* is an illustration of another embodiment of the system.

FIG. 6*a* depicts one embodiment of a system 600. In one embodiment, the force-generating component 302 may include a spring 207. The spring 207 may be compressed and installed between the first body 201 and the second body 202. In one embodiment, the system 600 may include a spring control component 601. The control component 301 may include the spring control component 601. Under an external force, e.g., the action of the spring control component 601, the restoring elastic force of the compressed spring 207 may not act on the first body 201 and the second body 202. In one embodiment, the spring control component 601 may release the external force on spring 207 according to the first control instruction. As illustrated in FIG. 6*b*, in response, the spring 207 may be released from the compressed state and generate a thrust force 602 between the spring 207 and the second body 202. The thrust force 602 may push the second body 202 away from the first body 201. In one embodiment, the first acting force 204 and/or the elastic force 208 may include the thrust force 602.

In some embodiments, the spring control component 601 may include a compression controller. The compression controller may keep the spring 207 in a compressed state and release the spring 207 from a compressed state in response to the compression controller being turned on. In response to the spring 20 being released, the spring 20 may push the second body 202 away from the first body 201.

Figure 7:
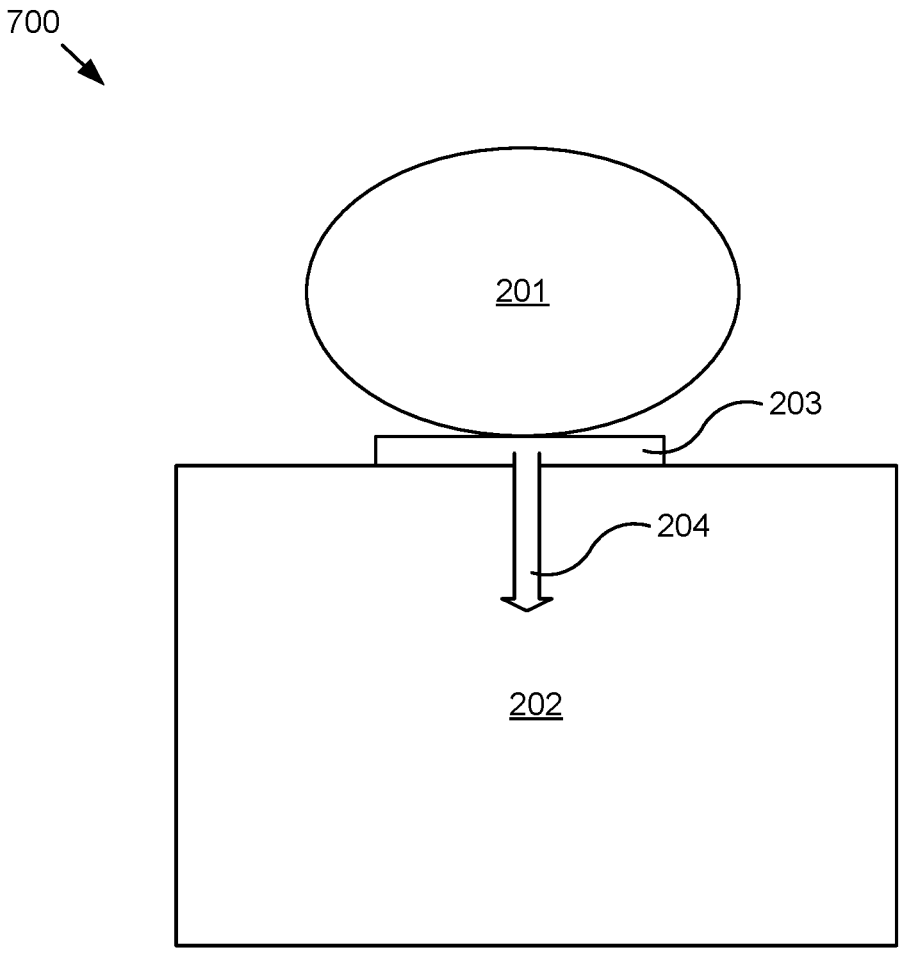
FIG. 7 is an illustration of one embodiment of an electronic device.

FIG. 7 depicts one embodiment of an electronic device 700. In one embodiment, the electronic device 700 may include the first body 201 and the second body 202. The electronic device 700 may include a force-applying apparatus 203 installed on the first body 201 in contact with the second body 202. The force-applying apparatus 203 may generate a first acting force 204. The first acting force 204 may push the second body 202 away from the first body 201.

In one embodiment, the electronic device 700 may include a projector. The projector may include a first body 201 and/or a second body 202. The first body 201 may include a portion, component, or the like of the projector that may rest upon the second body 202. The second body 202 may include a portion, component, or the like of the projector that supports the first body 201. For example, in one embodiment, the first body may include a projection lens and/or components that aid the projector in projecting an image and the second body may include a projector base. In some embodiments, the first body 201 and the second body may include other portions, components, or the like of a projector. The first body 201 may include a portion of the projector that is frequently removed, adjusted, or the like.

In one embodiment, the force-applying apparatus 203 may be installed on the first body 201 and adjacent to the second body 202. In some embodiments, the force-applying apparatus 203 may be installed adjacent to the first body 201 and the second body 202. In some embodiments, the force-applying apparatus 203 may be installed adjacent to either the first body 201 or the second body 202. The force-applying apparatus 203 may be installed on the first body 201 in contact with the second body 202. The force-applying apparatus 203 may generate a first acting force 204 and push the second body 202 away from the first body 201.

In some embodiments, the implementation, functionality, or the like of the force-applying apparatus 203 may include one or more implementations or functionality similar to embodiments described above.

Figure 8:
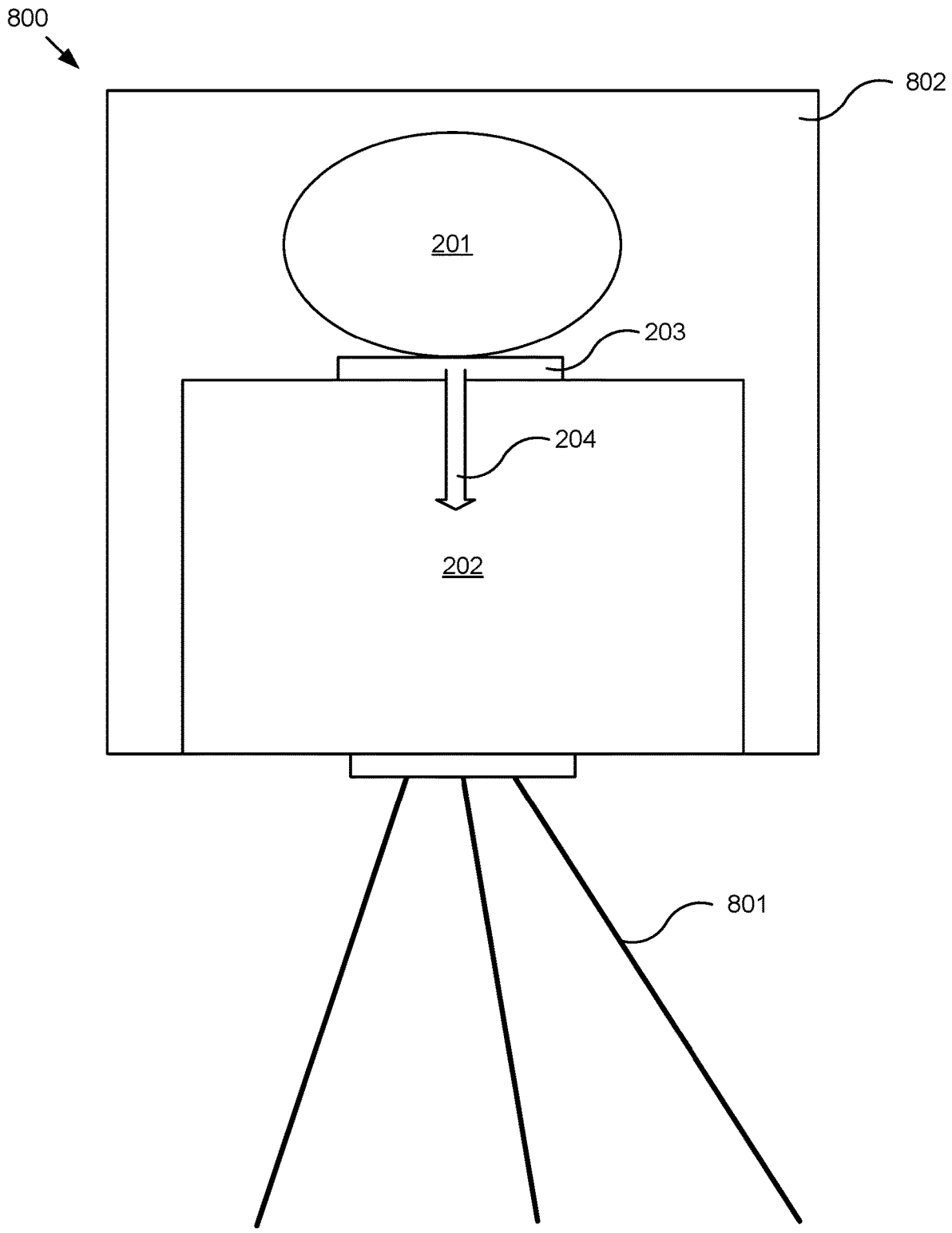
FIG. 8 is an illustration of one embodiment of a system.

FIG. 8 depicts one embodiment of a system 800. The system 800 may include a system body 801. The system 800 may include an electronic device 802. In one embodiment, the electronic device 802 may include a first body 201 and a second body 202. The electronic device 802 may include a force-applying apparatus 203 installed on the first body 201 in contact with the second body 202. The force-applying apparatus 203 may generate a first acting force 204. The first acting force 204 may push the second body 202 away from the first body 201.

In one embodiment, the system 800 may include a projection system. The system body 801 may include a supporting structure. For example, the system body 801 may include a stand. The stand may support at least a portion the electronic device 802. For example, the stand may selectively couple to the electronic device 802, the second body 202 of the electronic device 801, or the like. The system body 801 may include a bracket or the like for hanging the electronic device 802. For example, the bracket may suspend the electronic device 802 from a ceiling. The supporting structure may maintain the electronic device in a relatively fixed position. The system body 801 may include another supporting structure that one skilled in the art may recognize.

In one embodiment, the electronic device 802 may include a projector. The projector may include a first body 201 such as a projection lens and a second body 202 such as a projection base. The force-applying apparatus 203 may be installed on the first body 201 and disposed adjacent to the second body 202. The force-applying apparatus 203 may be installed on the first body 201 in contact with the second body 202. The force-applying apparatus 203 may generate a first acting force 204 and push the second body 202 away from the first body 201.

In one embodiment, the implementation, functionality, or the like of the force-applying apparatus 203 may include one or more implementations or functionality similar to embodiments described above.

The above embodiments are described as a combination of a series of actions. However, a person skill in the art shall know that the present application is not limited to the described action sequence. According to the present application, some steps may be conducted in other sequences or simultaneously. Moreover, a person skilled in the art shall also know that the embodiments described in the specification are some of many embodiments. The involved actions, modules, components, or the like are not required in all embodiments.

The embodiments in the specification may be described in a progressive manner, focusing on the differences from other embodiments. The identical or similar parts of the embodiments may be identified by cross referencing. For the devices disclosed in the embodiments, the description is relatively brief as they correspond to the methods disclosed in the embodiments.

It should be noted that, terms in the text, terms such as "first" and "second", are only to distinguish one entity or operation from another, and are not to require or imply an actual relationship or sequence between the entities or operations. Moreover, the terms "include," "including," or other variations thereof are intended to cover non-exclusive inclusions, such that a process, a method, an article, or a device that comprises a list of elements does not include only those elements, but may include other elements not expressly listed or inherent to such process, method, article, or device. An element defined by the phrase "include a" does not, without more constraints, preclude the existence of additional identical elements in the process, method, article, or device that comprises the element.

For convenience of description, the above-mentioned apparatus may be described separately in different functional units. Certainly, the function of each unit can be implemented in one or multiple software and/or hardware while implementing the present application.

A person skilled in the art should understand from the description of the above embodiments that the present application may be realized with the help of software and a necessary universal hardware platform. Based on this understanding, the technical schemes of the present application essentially, or as part of the technical schemes of the present application making contribution to the prior art, can be embodied in the form of a software product which can be stored in the storage medium such as ROM/RAM, diskette or optical disc, etc., comprising several instructions for one computer device (which can be a personal computer, a server, a network device or the like) to execute the embodiments of the present application or execute the method described by some parts of the embodiments. The storage medium may include a non-transitory storage medium.

The foregoing description of the disclosed embodiments enables a person skilled in the art to implement or use the present disclosure. Various modifications to the embodiments are obvious to a person skilled in the art, and general principles defined in this description may be implemented in other embodiments without departing from the spirit or scope of the present disclosure. Therefore, the present disclosure is not be limited to the embodiments described in this description, but rather extends to the widest scope that complies with the claims and description.

What is claimed is:

1. A method comprising:

providing a force-applying apparatus installed on a projection lens;

coupling, via a force, the projection lens and a projection base;

receiving, through the force-applying apparatus, a first control instruction; and in response to receiving the first control instruction, generating a first acting force from the force-applying apparatus based on the first control instruction, wherein:

the force-applying apparatus is disposed between the projection lens and the projection base, the projection lens and the projection base are coupled via the force, and the first acting force pushes the projection base away from the projection lens with an amount of force that decouples the projection lens and the projection base to completely disconnect the projection lens from the projection base allowing removal of the projection lens by a user.

2. The method of claim 1, wherein:

providing the force-applying apparatus comprises providing an electromagnet;

generating the first acting force comprises the electromagnet producing, in response to the first control instruction, a first magnetic polarity; and the first magnetic polarity is one of greater than and equal to a second magnetic polarity of the projection base that generates at least a portion of the force coupling the projection lens and the projection base.

3. The method of claim 2, wherein:

producing the first magnetic polarity comprises the electromagnet generating a repelling magnetic force between the electromagnet and the projection base; and the first magnetic force pushes the projection base away from the projection lens with the amount of force that completely disconnects the projection lens from the projection base.

4. The method of claim 1, wherein:

providing the force-applying apparatus comprises providing a spring; and generating the first acting force comprises the spring moving, in response to receiving the first control instruction, from a compressed state to a relaxed state.

5. The method of claim 4, wherein:

the spring moving from the compressed state to the relaxed state generates a thrust force between the spring and the projection base; and the thrust force pushes the projection base away from the projection lens with the amount of force that completely disconnects the projection lens from the projection base.

6. The method of claim 1, wherein receiving the first control instruction comprises wirelessly receiving the first control instruction.

7. An apparatus comprising:

a control component configured to receive a first control instruction; and a force-generating component configured to generate a first acting force based on the first control instruction, wherein:

the apparatus is arranged between a projection lens and a projection base, the projection lens and the projection base are coupled via a force, the force-generating component generates the first acting force in response to receiving the first control instruction, and the first acting force pushes the projection base away from the projection lens with an amount of force that decouples the projection lens and the projection base to completely disconnect the projection lens from the projection base allowing removal of the projection lens by a user.

8. The apparatus of claim 7, wherein:

the force-generating component comprises an electromagnet configured to produce, in response to the first control instruction, a first magnetic polarity; and the first magnetic polarity is one of greater than and equal to a second magnetic polarity of the projection base that generates at least a portion of the force coupling the projection lens and the projection base.

9. The apparatus of claim 8, wherein:

the first magnetic polarity comprises a repelling magnetic force between the electromagnet and the projection base; and the first magnetic force pushes the projection base away from the projection lens with the amount of force that completely disconnects the projection lens from the projection base.

10. The apparatus of claim 8, wherein the control component comprises:

a power transmission line; and a switch module, wherein the power transmission line, the switch module, and the electromagnet form a powered-up circuit configured to generate the first magnetic polarity in response to powering up.

11. The apparatus of claim 10, wherein the switch module comprises at least one of a touch switch and a button.

12. The apparatus of to claim 7, wherein:

the force-generating component comprises a spring configured to move, in response to the first control instruction, from a compressed state to a relaxed state;

the force-generating component configured to generate a thrust force between the spring and the projection base; and the thrust force pushes the projection base away from the projection lens with the amount of force that completely disconnects the projection lens from the projection base.

13. The apparatus of claim 12, wherein the control component comprises a compression controller configured to maintain the spring in the compressed state and move the spring from the compressed state to the relaxed state in response to the compression controller activating.

14. The apparatus of claim 7, wherein the control component comprises a wireless communication interface.

15. A system comprising:

a system body; and an electronic device comprising:

a projection base coupled to the system body, a projection lens coupleable to the projection base via a force, and a force-applying apparatus installed on the projection lens, wherein:

the force-applying apparatus is disposed between the projection lens and the projection base, the projection lens and the projection base are coupled via the force, the force-applying apparatus is configured to generate, in response to receiving a command signal, a first acting force on the projection base when the projection lens and the projection base are coupled via the force, and the first acting force includes an amount of force that decouples the projection lens and the projection base to completely disconnect the projection lens from the projection base allowing removal of the projection lens by a user.

16. The system of claim 15, wherein:

the force-applying apparatus comprises an electromagnet configured to produce, in response to the force-applying apparatus receiving a first control instruction, a first magnetic polarity; and the first magnetic polarity of one of greater than or equal to a second magnetic polarity of the projection base that generates at least a portion of the force coupling the projection lens and the projection base.

17. The system of claim 16, wherein:

the first magnetic polarity comprises a repelling magnetic force between the electromagnet and the projection base; and the first magnetic force pushes the projection base away from the projection lens with the amount of force that completely disconnects the projection lens from the projection base.

18. The system of to claim 15, wherein:

the force-applying apparatus comprises a spring configured to move, in response to the force-applying apparatus receiving a first control instruction, from a compressed state to a relaxed state;

the force-applying apparatus is configured to generate a thrust force between the spring and the projection base; and the thrust force pushes the projection base away from the projection lens with the amount of force that completely disconnects the projection lens from the projection base.

19. The system of claim 18, wherein the force-applying apparatus comprises a compression controller configured to maintain the spring in the compressed state and move the spring from the compressed state to the relaxed state in response to the compression controller activating.

20. The system of claim 15, wherein the system body comprises a supporting structure configured to maintain the electronic device in a fixed position.

* * * * *